US008905802B2

(12) United States Patent
Ramelot et al.

(10) Patent No.: US 8,905,802 B2
(45) Date of Patent: Dec. 9, 2014

(54) BUOYANT BOARD

(71) Applicants: Steve Ramelot, Huntington Beach, CA (US); Raphael John Joseph, Laguna Beach, CA (US)

(72) Inventors: Steve Ramelot, Huntington Beach, CA (US); Raphael John Joseph, Laguna Beach, CA (US)

( * ) Notice: Subject to any disclaimer, the term of this patent is extended or adjusted under 35 U.S.C. 154(b) by 10 days.

(21) Appl. No.: 13/832,227

(22) Filed: Mar. 15, 2013

(65) Prior Publication Data

US 2014/0273679 A1 Sep. 18, 2014

(51) Int. Cl.
*B63B 35/00* (2006.01)
*B63B 35/79* (2006.01)

(52) U.S. Cl.
CPC ..... *B63B 35/7913* (2013.01)
USPC ..... 441/66; 114/352

(58) Field of Classification Search
USPC ..... 114/352; 441/65, 66, 74
See application file for complete search history.

(56) References Cited

U.S. PATENT DOCUMENTS 2,513,857 A * 7/1950 Friedrich ..... 441/66
2,666,933 A * 1/1954 Engensperger ..... 114/352

* cited by examiner

*Primary Examiner* — Lars A Olson
(74) *Attorney, Agent, or Firm* — Bryan Cave LLP

(57) ABSTRACT

An extendable buoyant board with pairs of telescoping sections which are secured in an extended relation to one another by internal pressure from an inflatable pneumatic bladder enclosed within the sections. By retaining each of the inboard ends of successively smaller pairs of extension sections within the adjacent next larger section, the multisection board, when extended, provides substantial rigidity and strength. The telescoping arrangement is preferably provided by a central tubular section with an opening at each end, and an internal cross-sectional area which diminishes from the center to each opening. A first pair of opposed telescoping tubular extension sections is slidably and non-removably engaged within the outboard end of the interior of the central section.

14 Claims, 9 Drawing Sheets

BUOYANT BOARD

THE FIELD OF THE INVENTION

The present invention is directed to a floating board and vessel which can be used for recreational and transportation purposes, such as surfboards, sailboards, kite surfing boards, paddleboards, kayaks, canoes, boats and windsurfing boards, and which can be easily transported and stored.

THE BACKGROUND ART

There are a variety of types of floating boards and vessels used for recreational and transportation purposes, including surfboards, sailboards, kite surfing boards, paddleboards, kayaks, canoes, boats and windsurfing boards. Because the ability of a board or vessel to support a load is dependent upon the volume of water it displaces, the volume, and therefore the length and other dimension of such boards by necessity are substantial. Because of the substantial size and bulk of such boards, transportation and storage presents difficulties. Prior efforts at alleviating such difficulties, such as constructing boards comprised of demountable sections, have not produced satisfactory results in the strength, rigidity and performance characteristics of the boards, in addition to the complicated and time-consuming procedures required for assembly and disassembly of such boards.

BRIEF SUMMARY OF THE INVENTION

In view of the foregoing, in accordance with the invention as embodied and broadly described herein, a method and apparatus are disclosed for providing a floating board or vessel which can be easily transported and stored. In one embodiment, the present invention comprises an extendable buoyant board with pairs of telescoping sections which are secured in an extended relation to one another by internal pressure from an inflatable pneumatic bladder enclosed within the sections. By retaining each of the inboard ends of successively smaller pairs of extension sections within the adjacent next larger section, the multisection board, when extended, provides substantial rigidity and strength. In another embodiment, the present invention comprises an extendable buoyant boat, such as a kayak or canoe, with telescoping sections which are secured in an extended relation to one another by internal pressure from an inflatable pneumatic bladder enclosed within the sections.

In one embodiment, the telescoping arrangement is preferably provided by a central tubular section with an opening at each end, and an internal cross-sectional area which diminishes from the center to each opening. A first pair of opposed telescoping tubular extension sections is slidably and non-removably engaged within the outboard end of the interior of the central section.

As further described in greater detail below, there are various configurations which can provide the non-removable sliding engagement of the extension sections to the central section, to provide an interlocking arrangement of substantial strength and integrity, including:

(1) configuring the inboard end of the extension section with an external sectional profile which is larger than the opening in the central section, thus providing an interference fit between the adjoining sections;

(2) configuring the opening of the central section with a lip which extends inward into the opening to mate with a corresponding outer flange on the inboard end of the extension section;

(3) use of a mating arrangement of outward protrusions on the inboard end of the extension section with corresponding recesses on the interior surface of the central section to prevent the extension section from extending beyond the recess; and (4) configuring the inboard end of the extension section with a recess, which engages a corresponding protrusion on the interior surface of the central section, preferably in proximity to the opening.

If desired, using these same engagement configurations, successively smaller pairs of extension sections can additionally be slidably and non-removably engaged within the outboard end of the interior of the adjacent next larger section to provide additional sections for a board of greater length. After use, when the board is desired to be transported and stored, the bladder is deflated and the extensions may be retracted to the collapsed position in the interior of the central section.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
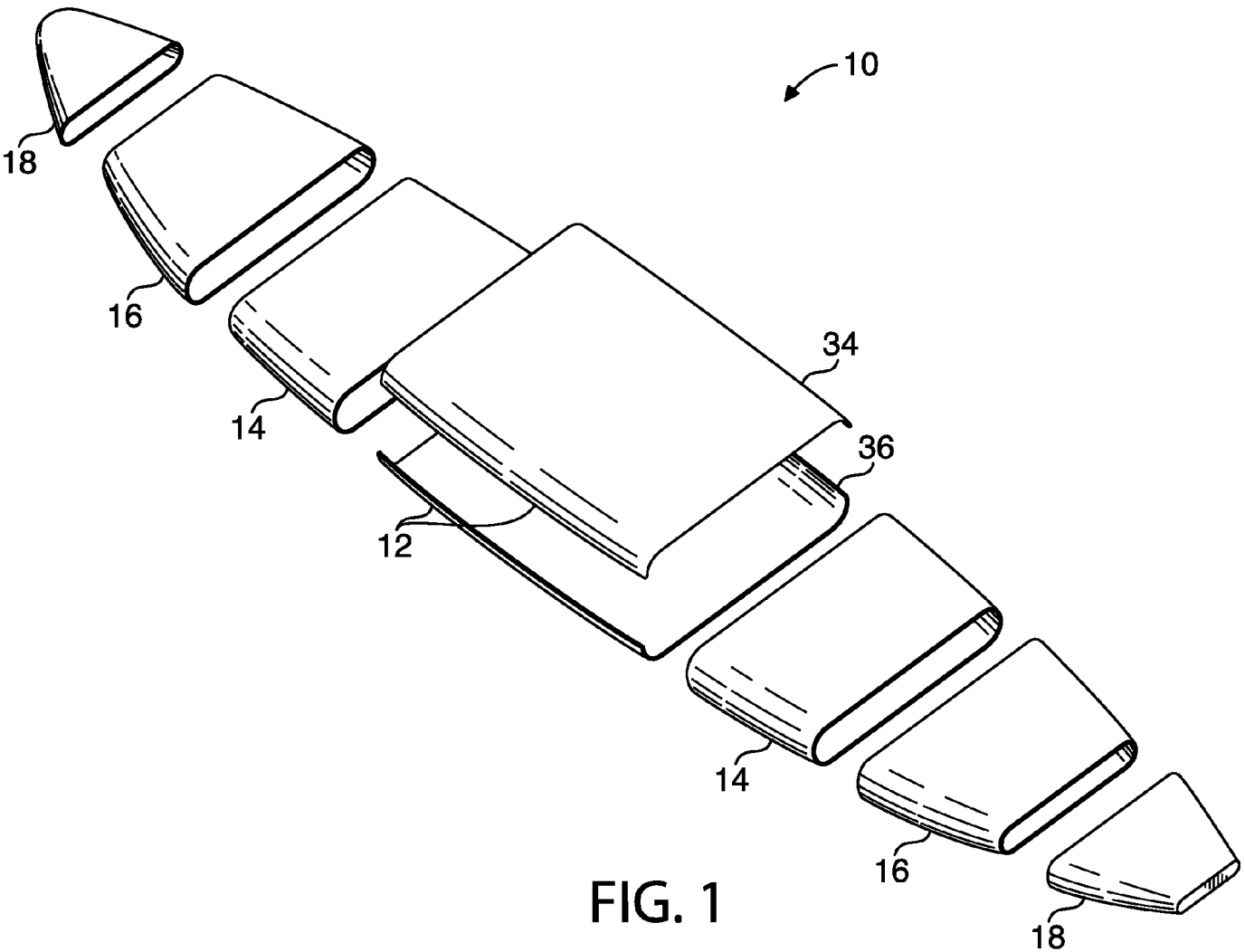
FIG. 1 is an exploded perspective view of one embodiment of a buoyant board in accordance with the present invention showing the component sections prior to assembly.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout.

As shown in FIG. 1, in one embodiment, the present invention comprises an extendible board 10 having seven sections. FIG. 1 illustrates the component sections prior to assembly. These sections include the central section 12 comprised of upper and lower parts 34 and 36, respectively, and pairs of extension sections 14, 16, and 18 respectively, having progressively smaller cross-sectional profiles as the sections progress in the outboard direction. These progressively smaller cross-sectional profiles enable each one of the extension sections 14, 16, and 18 to nest within the adjacent inboard section in the collapsed configuration. In this embodiment, extension sections 18 comprise the end sections and accordingly they are configured with openings on the inboard ends, but are closed on the outboard end. Preferably, the longitudinal dimension of each extension section 14, 16, and 18 does not exceed one-half of the length of the central section 12, so that all of the pairs of the extension sections 14, 16, and 18 will fit within the central section 12 in the collapsed configuration.

Figure 2:
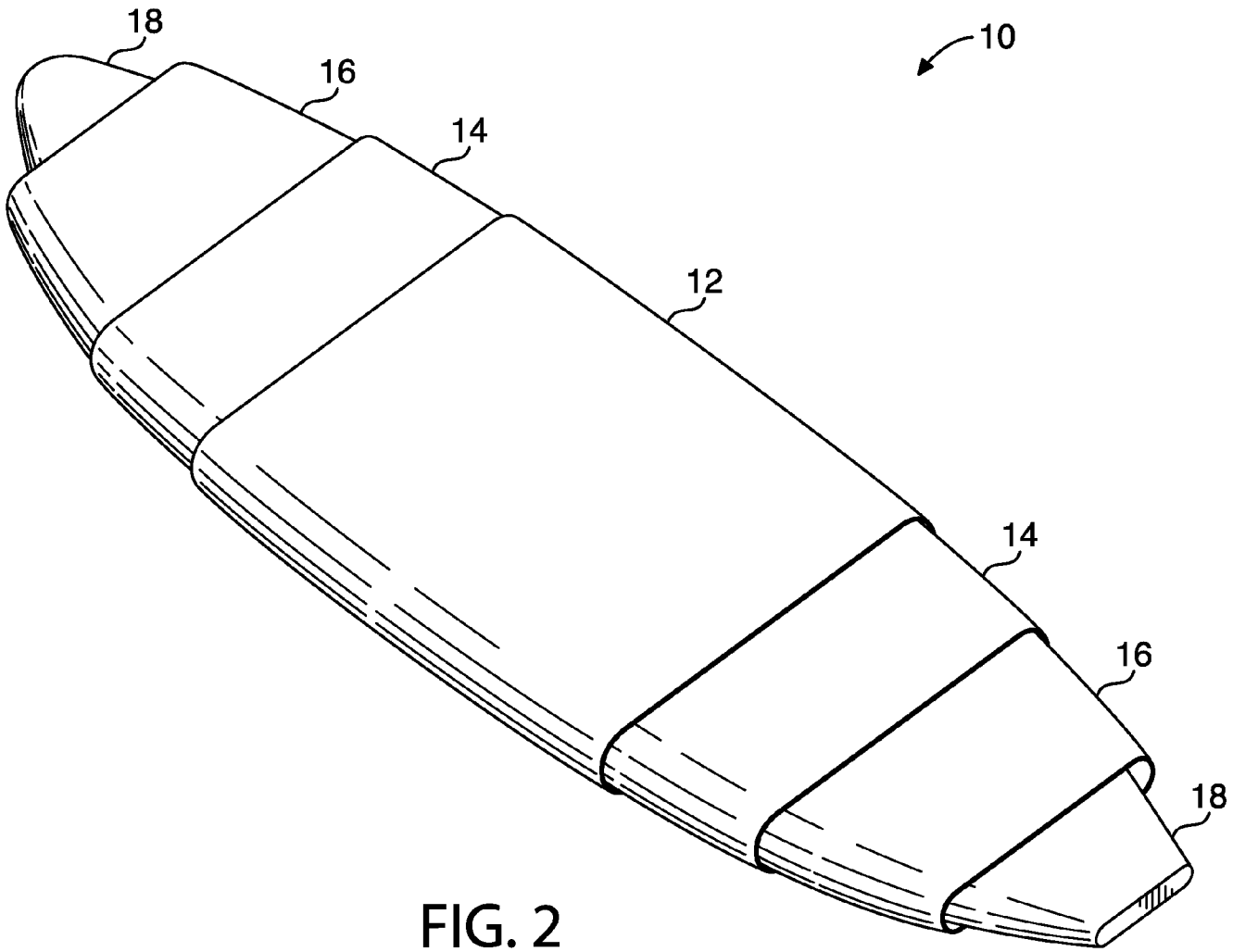
FIG. 2 is a perspective view of one embodiment of a buoyant board in accordance with the present invention showing the assembled component sections in the collapsed configuration.

The board sections are preferably made of semi-rigid or rigid fiberglass or plastic material. As shown in FIG. 2, in one embodiment, the upper and lower parts 34 and 36, respectively, of central section 12 are preferably joined with at least the inboard ends of the first pair of extension sections 14 contained within the interior portion of the central section 12, with the inboard ends of the extension sections 18 at least partially inside extension section 16, and with the inboard ends of the extension sections 16 at least partially inside extension section 14. The central section 12 is preferably constructed of upper and lower sections 34 and 36, respectively, which are joined along longitudinal joints using adhesives, or heat fusing. Alternatively, central section 12 may be formed with a single longitudinal separation to permit insertion of extension sections, with subsequent joining of the separation using adhesives, or heat fusing. The openings 22 in the ends of central section 12 are configured and sized to prevent the inboard ends of the first pair of extension sections 14 from passing through the openings 22. Each successive pair of extension sections is preferably similar in size and cross-sectional shape to each other at the inboard end so that when the pair of extension sections are retracted to the collapsed position in the interior of the central section, the inboard ends of the pair of the extension sections will abut one another in the approximate midpoint of the central section.

Figure 3:
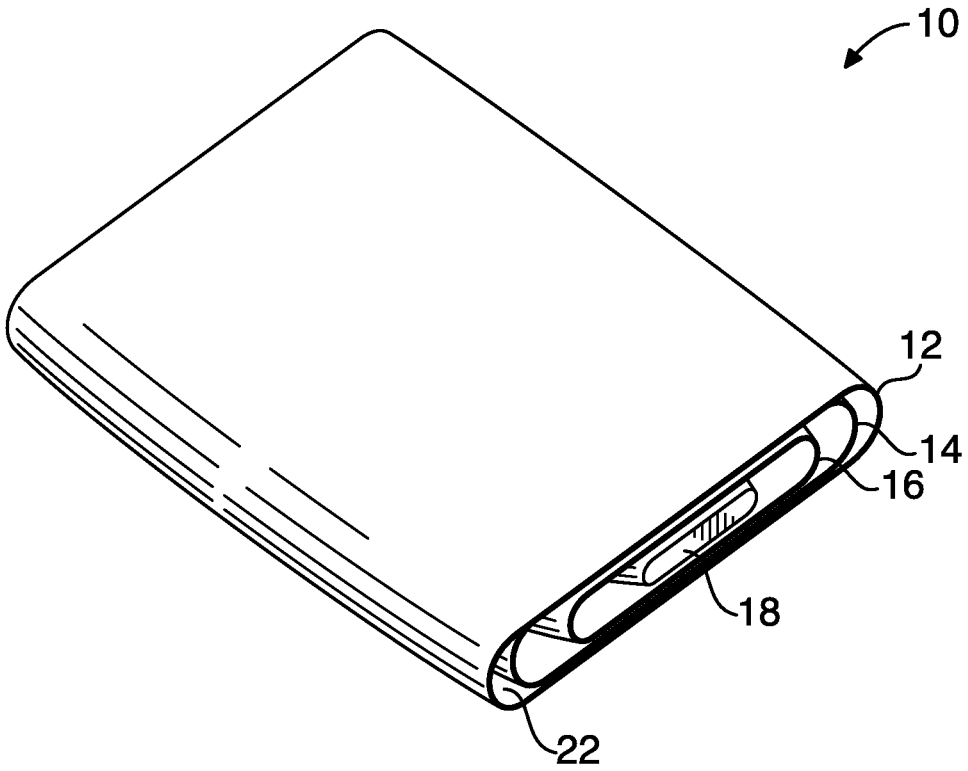
FIG. 3 is a perspective view of one embodiment of a buoyant board in accordance with the present invention showing the assembled component sections in the partially collapsed configuration.

As shown in FIG. 3, the collapsed configuration thus provides a minimal length which preferably is approximately the same as the length of the central section. Accordingly, the extension sections can be conveniently and efficiently transported and stored with in the envelope of the central section 12. By providing multiple pairs of opposing extension sections of increasingly reduced size, a telescoping the arrangement of multiple extension sections extending outwardly in both directions from the central section 12 provides a board 10 of substantial length and volume. Additionally, any of the sections of the board 10 may be configured to receive components to enhance the performance characteristics of a given board, such as tailfins, skegs, keels, sail mast riggings and foot straps.

Figure 4:
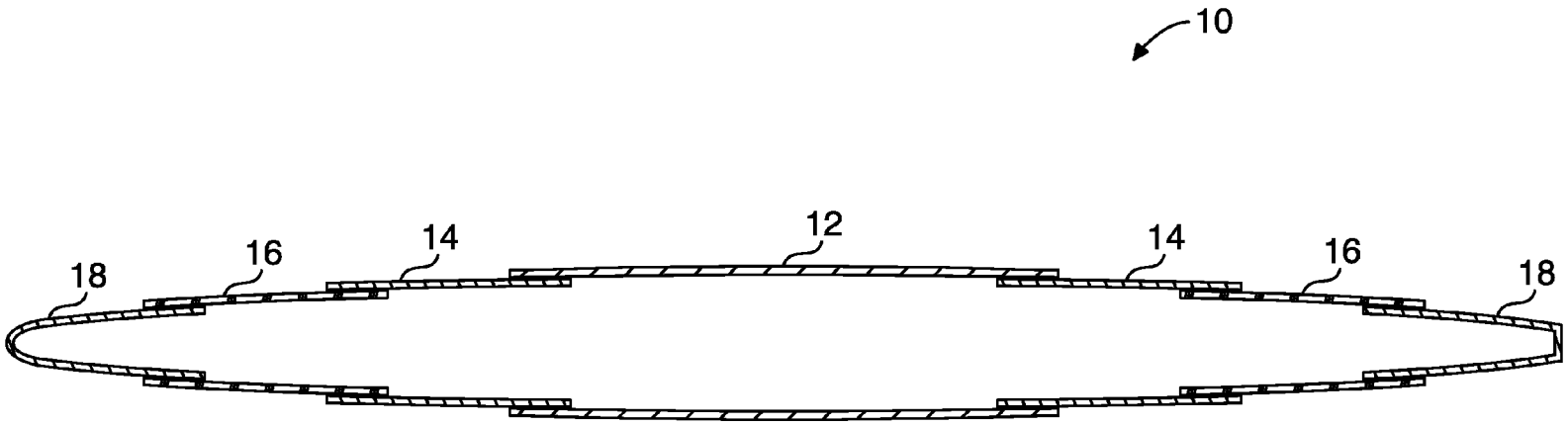
FIG. 4 is a cross-sectional view of one embodiment of a buoyant board in accordance with the present invention showing the assembled component sections in the extended configuration.

FIG. 4 illustrates the board 10 with each of the extension sections in their fully extended orientation, in the outboard direction.

Pneumatic Bladder

Figure 5:
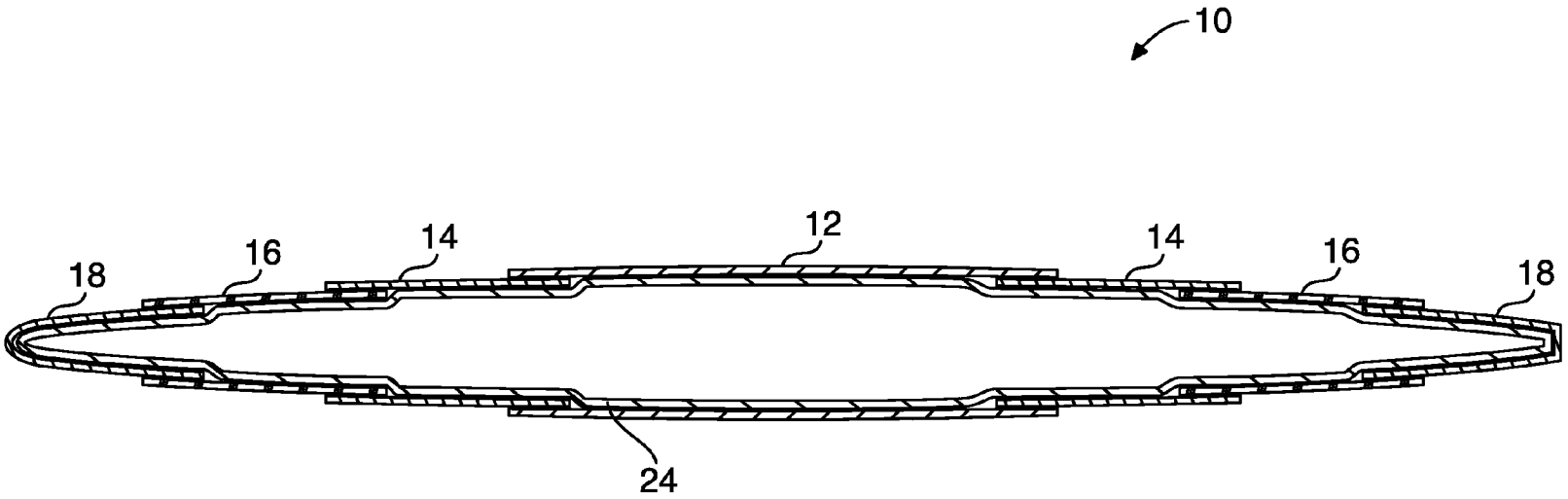
FIG. 5 is a cross-sectional view of one embodiment of a buoyant board in accordance with the present invention showing the assembled component sections retained in the extended configuration by the inflated pneumatic bladder.

As shown in FIG. 5, in one embodiment, a pneumatic bladder 24 is provided with a form which substantially conforms to the interior of the board 10 with all of the sections in the extended position. The bladder is preferably formed of a flexible wear-resistant and weather-resistant impervious material, such as butyl rubber, Hypalon coated neoprene, and urethane polymers, such as polyurethane coated nylon fabric.

As shown in FIG. 5, by inflating the bladder 24 with sufficient pressure in the interior of the sections of the board 10, it restrains each of the extension sections in their extended orientations towards the in the fully outboard direction, thus enhancing the strength and integrity of the board. Bladder 24 also prevents the incursion of water through the joints between the board sections. Bladder 24 may be secured to one or more of the central section 12 and/or the extension sections 14, 16, and 18 to maintain proper orientation when inflated. Bladder 24 may be inflated with a variety of air compressed air or gas sources, Including hand pumps, foot pumps, bicycle pumps, air compressors, compressed air tanks, or oral inflation fittings. The valves to accommodate such inflation sources may be located at various locations on the board 10, including the forward or aft ends of the board, or in recessed locations on the top or bottom surface of the board.

Retention Methods

Figure 6:
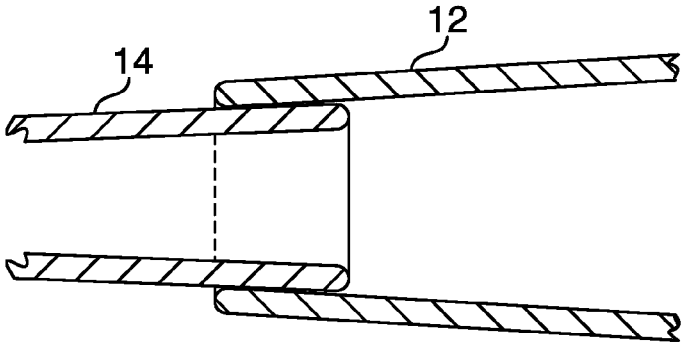
FIG. 6 is a cross-sectional view of one embodiment of a buoyant board in accordance with the present invention showing the inboard end of the extension section with an external sectional profile which is larger than the opening in the central section, thus providing an interference fit between the adjoining sections.

The present invention comprises various configurations which can be used to retain the inboard ends of each of the successively smaller pairs of extension sections within the central section 12, or adjacent next larger section to provide a multi-section board which, when extended, provides substantial rigidity and strength. As shown in FIGS. 4, 5 and 6, one method of retaining the inboard end of the extension sections within the central section 12 is to configure the inboard end of the extension section with a an external cross sectional profile which is larger than the opening in the central section. In the extended position, this configuration produces an interference fit between the adjoining sections, which provides an interlocking engagement for substantial strength and integrity.

Figure 7A:
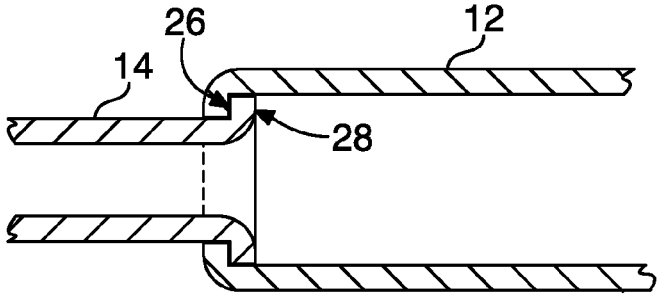
FIG. 7A is a cross-sectional view of one embodiment of a buoyant board in accordance with the present invention showing the flange and lip mating arrangement between the central section and the inboard end of the first extension section oriented in a plane transverse to the longitudinal axis of the board.
Figure 7B:
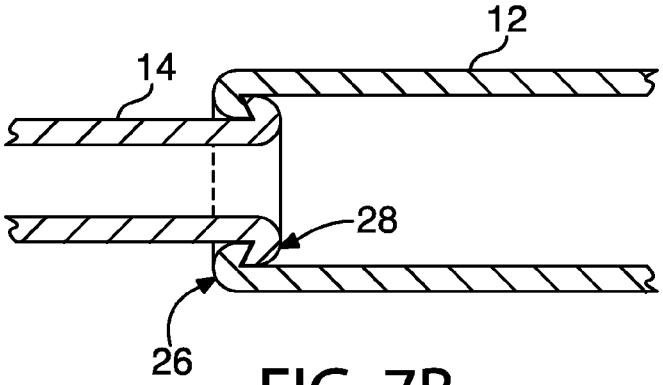
FIG. 7B is a cross-sectional view of one embodiment of a buoyant board in accordance with the present invention showing the flange and lip mating arrangement between the central section and the inboard end of the first extension section oriented in a plane inclined both inwardly and in the inboard direction.

Alternatively, as shown in FIGS. 7A and 7B, the opening of the central section 22 may comprise a lip 26, which extends inward into the opening 22, and is configured to mate with a corresponding outer flange 28 on the inboard end of the first extension section. This flange and lip mating arrangement may be oriented in a plane transverse to the longitudinal axis of the board 10 as shown in FIG. 7A, or may be inclined both inwardly and in the inboard direction as illustrated in FIG. 7B to produce a ore compact joint.

Figure 8A:
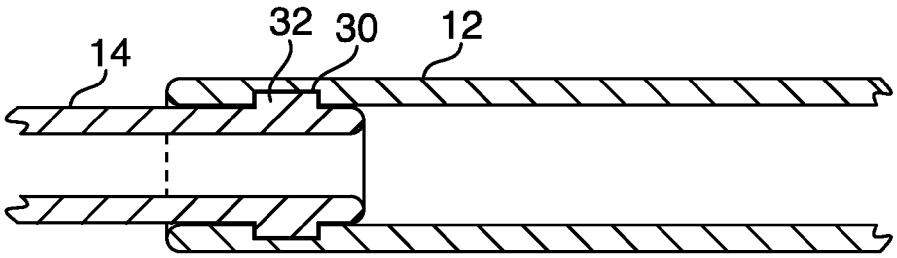
FIG. 8A is a cross-sectional view of one embodiment of a buoyant board in accordance with the present invention showing the mating arrangement between outward protrusions on the inboard end of the extension section and corresponding recesses on the interior surface of the central section.
Figure 8B:
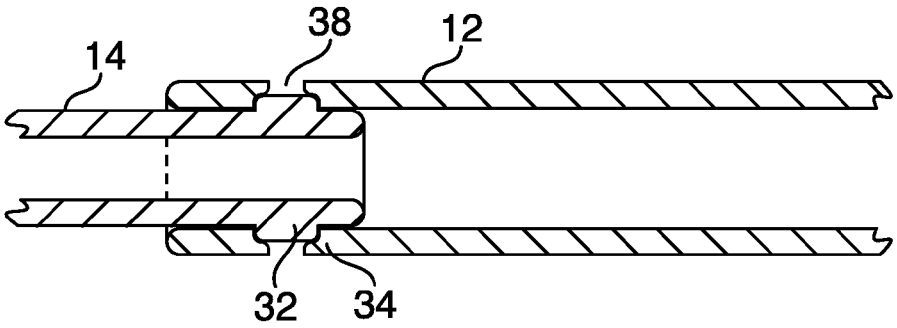
FIG. 8B is a cross-sectional view of one embodiment of a buoyant board in accordance with the present invention showing the mating arrangement between outward protrusions on the inboard end of the extension section and corresponding recesses on the interior surface of the central section with a detent which is biased to retain the protrusion in the recess until the protrusion is released by manual force against the bias applied through an opening in the exterior surface of the central section.

As shown FIGS. 8A and 8B, the retention of the extension sections within the central section may be also be achieved through use of a mating arrangement of outward protrusions on the inboard end of the extension section which mate with corresponding recesses on the interior surface of the central section to prevent the extension section from extending beyond the recess. As shown FIG. 8B, the recess 30 may be configured with a detent which is biased to retain the protrusion 32 outwardly within the recess 30 when the extension section in the fully extended position so that it remains locked in position until the protrusion 32 is manually released against the bias, for example, by inward manual pressure applied to the protrusion 32 through an opening 32 in the exterior surface of the central section. The bias may be provided by the elastic structural resilience of the semi-rigid material of which the central section and/or the extension section is formed.

Figure 9:
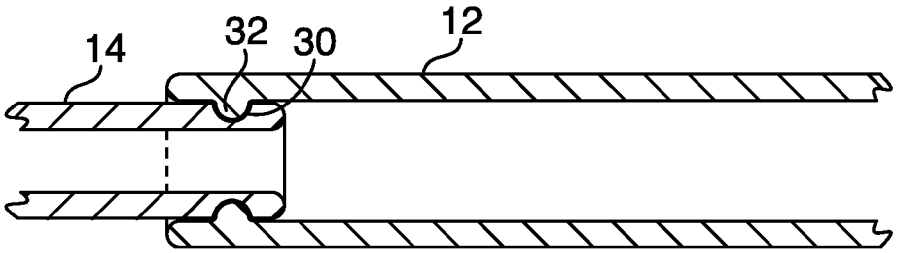
FIG. 9 is a cross-sectional view of one embodiment of a buoyant board in accordance with the present invention showing the mating arrangement between a recess on the inboard end of the extension section and a corresponding protrusion on the interior surface of the central section.

As illustrated in FIG. 9, another configuration for providing the nonremovable restraint of the extension sections is a recess 30 formed on the inboard end of the extension section to engage a corresponding protrusion 32 on the interior surface of the central section 12, preferably in proximity to the opening 22.

In another embodiment, the extendible buoyant board of the present invention may include a tubular section that has a raised longitudinal rib formed on the exterior surface which is configured to slidably engage a conforming longitudinal groove formed on the interior surface of an adjoining tubular section to provide proper alignment of the tubular sections during the extension and collapsing processes.

Extendable Vessel

Figure 10:
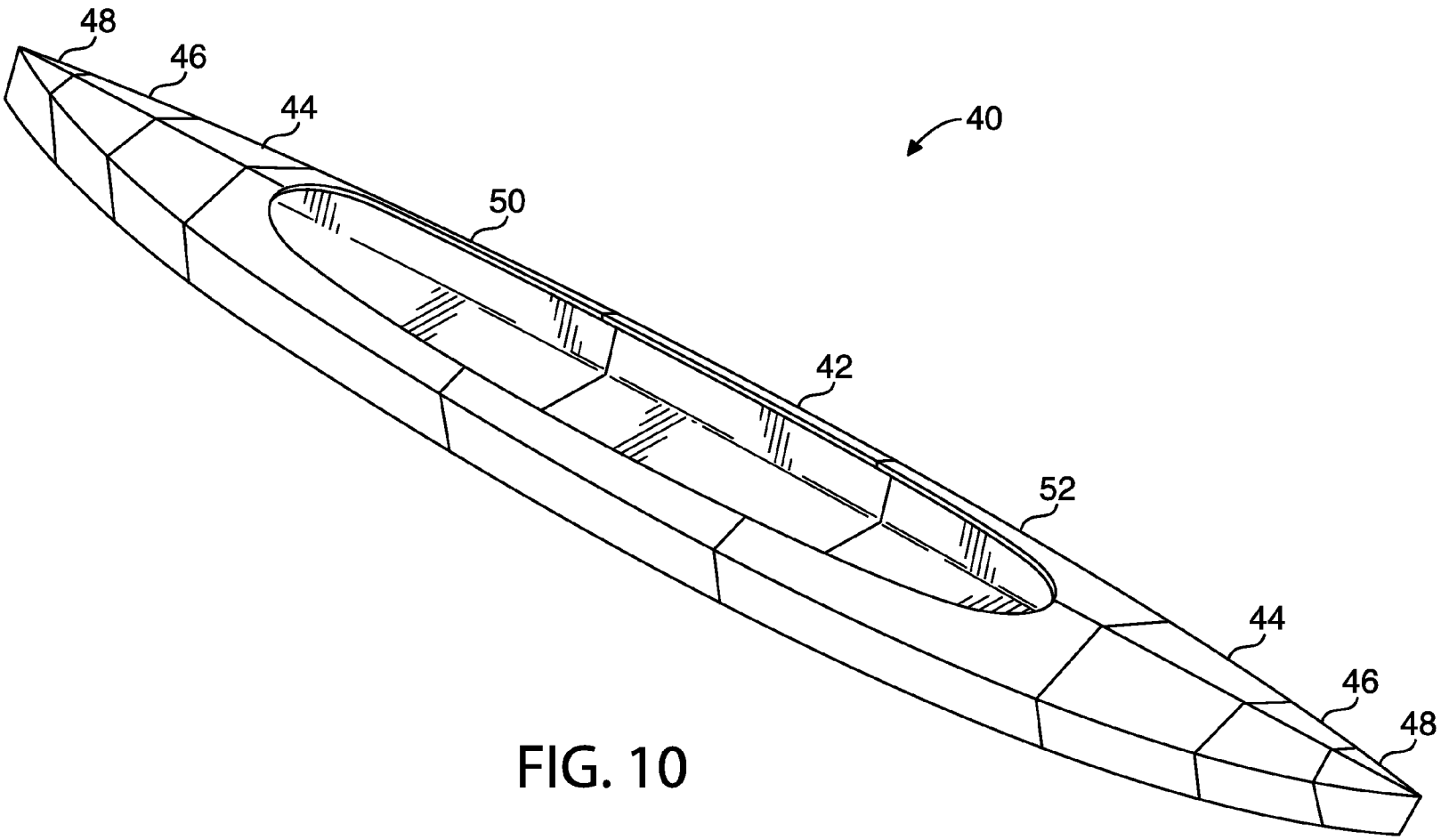
FIG. 10 is a perspective view of one embodiment of a vessel in accordance with the present invention showing the assembled component sections in the extended configuration.

In another preferred embodiment of the present invention an extendable vessel 40 such as a canoe, kayak, or boat is provided. The vessel 40 is comprised of pairs of telescoping sections which are secured in an extended relation to one another by internal pressure from an inflatable pneumatic bladder enclosed within the sections. As shown in FIG. 10, a vessel is comprised of a center section 42 which has a smaller cross-sectional area than the inboard ends of adjoining intermediate sections 50, such that a portion of center section 42 may be collapsed within each of the intermediate sections 50. At the outboard ends of intermediate sections 50 are extension sections 44, 46 and 48.

As shown in FIG. 10, in one embodiment, the present invention comprises an extendible board 10 having nine sections. FIG. 10 illustrates the component sections after assembly. These sections include the intermediate section 50 comprised of upper and lower parts 52 and 54, respectively, and pairs of extension sections 44, 46 and 48 respectively, having progressively smaller cross-sectional profiles as the sections progress in the outboard direction. These progressively smaller cross-sectional profiles enable each one of the extension sections 44, 46 and 48 to nest within the adjacent inboard section in the collapsed configuration. In this embodiment, extension sections 48 comprise the end sections and accordingly they are configured with openings on the inboard ends, but are closed on the outboard end. Preferably, the longitudinal dimension of each extension section 44, 46 and 48 does not exceed one-half of the length of the intermediate section 50, so that all of the pairs of the extension sections 44, 46 and 48 will fit within the outboard end of the intermediate section 50 and one-half of the length of the center section 42 will fit within the inboard end of the intermediate section 50 in the collapsed configuration.

The vessel sections are preferably made of semi-rigid or rigid fiberglass or plastic material. The upper and lower parts 52 and 54, respectively, of intermediate section 50 are preferably joined with at least the inboard ends of the first pair of extension sections 44 contained within the interior portion of the intermediate section 50, with the inboard ends of the extension sections 48 at least partially inside extension section 46, and with the inboard ends of the extension sections 46 at least partially inside extension section 44. The upper and lower parts 52 and 54, respectively, of intermediate section 50 are also preferably joined with an outboard end of the center section 42 contained within the interior portion of the intermediate section 50. The upper and lower parts 52 and 54, respectively, of intermediate section 50 are preferably joined along longitudinal joints using adhesives, or heat fusing. Alternatively, intermediate section 50 may be formed with a single longitudinal separation to permit insertion of extension sections 44, 46 and 48 and center section 42, with subsequent joining of the separation using adhesives, or heat fusing. The outboard openings in the ends of intermediate section 50 are configured and sized to prevent the inboard ends of the first pair of extension sections 44 from passing through the openings. The inboard openings in the ends of intermediate section 50 are configured and sized to prevent the ends of the center section 42 from passing through the openings.

Figure 11:
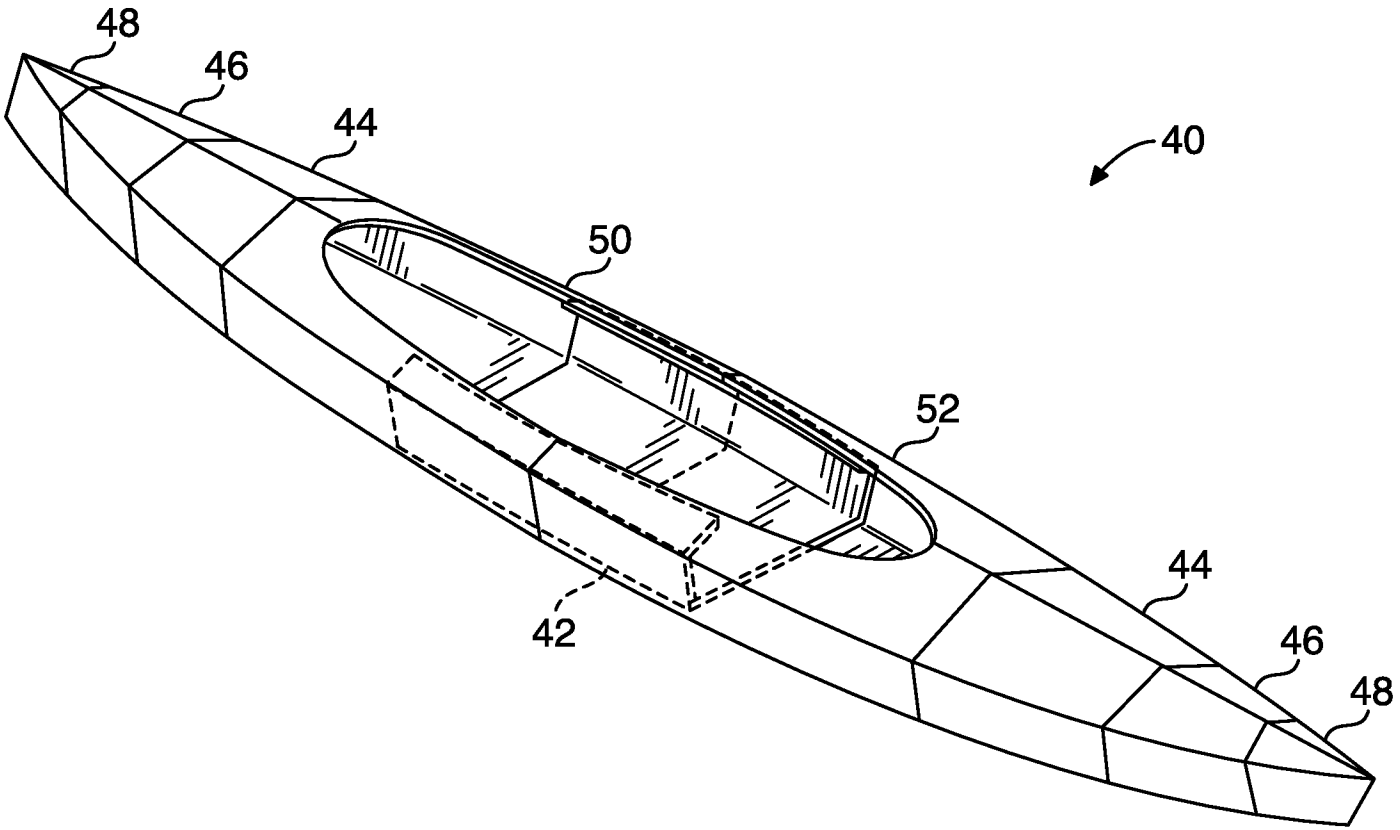
FIG. 11 is a perspective view of one embodiment of a vessel in accordance with the present invention showing the assembled component sections in the collapsed configuration.

As shown in FIG. 11, the collapsed configuration thus provides a minimal length which preferably is approximately the same as the length of the two intermediate sections 50. Accordingly, the extension sections and center section 42 can be conveniently and efficiently transported and stored with in the envelope of the two intermediate sections 50. By providing multiple pairs of opposing extension sections 44, 46 and 48 of increasingly reduced size, a telescoping the arrangement of multiple extension sections extending outwardly in the outboard direction from the two intermediate sections 50 provides a vessel 40 of substantial length and volume. Additionally, any of the sections of the vessel 40 may be configured to receive components to enhance the performance characteristics of a given vessel, such as rudders, tailfins, skegs, keels, sail mast riggings and seats.

As is appreciated and understood by those of ordinary skill in the art, various combinations and modifications of these configurations may be employed to produce the non-removable engagement between the corresponding sections of the buoyant board.

In summary, a preferred embodiment of the present invention comprises an extendible buoyant board, comprising a central tubular section having an opening at each end, a first pair of opposing tubular extension sections longitudinally slidably and non-removably engaged with the central section, each extension section having an inboard end with an opening, and a pneumatic bladder disposed in the interior of the tubular sections.

In another preferred embodiment, the present invention comprises an extendible buoyant board with a first pair of opposing tubular extension sections, each of which has an opening in the outboard end and a second pair of opposing tubular extension sections longitudinally slidably and non-removably engaged with a respective one of the first pair of opposing tubular extension sections.

In another preferred embodiment, the present invention comprises a method for providing an extendible buoyant board by use of a bladder secured to a tubular section which has a valve to selectively receive and release compressed gas.

These examples are provided for the purposes of illustration and the present invention is not limited to them.

What is claimed is:

1. An extendible buoyant board, comprising:

a central tubular section having an opening at each end;

a first pair of opposing tubular extension sections longitudinally slidably and non-removably engaged with the central section, each extension section having an inboard end with an opening; and a pneumatic bladder disposed in the interior of the tubular sections.

2. The extendible buoyant board of claim 1 wherein the central tubular section has an interior cross-sectional area which diminishes from the center towards the openings, and the inboard ends of each of the tubular extension sections has an opening and a greater outer cross-sectional area than the outboard end, an outer cross-sectional profile at the inboard end of sufficient size to prevent the inboard end of the extension section from extending beyond the respective one of the openings of the central section.

3. The extendible buoyant board of claim 1 wherein the central tubular section has a lip extending into the opening and the tubular extension sections have an inboard end with a flange extending outward from the inboard end configured to engage the lip of the respective opening of the central section.

4. The extendible buoyant board of claim 1 wherein the central tubular section has a plurality of recesses configured to receive outward protrusions and the tubular extension sections have an inboard end with a plurality of outward protrusions configured to engage one or more of the recesses of the central section.

5. The extendible buoyant board of claim 1 wherein the central tubular section has a plurality of inward protrusions and each of the tubular extension sections have an inboard end with a plurality of recesses configured to receive one or more of the inward protrusions of the central section.

6. The extendible buoyant board of claim 1, wherein each of the first pair of opposing tubular extension sections has an opening in the outboard end and the board further comprises a second pair of opposing tubular extension sections longitudinally slidably and non-removably engaged with a respective one of the first pair of opposing tubular extension sections.

7. The extendible buoyant board of claim 6 wherein each of the second pair of extension sections has an inboard end with an opening and a greater external cross-sectional area than the outboard end, the outer cross-sectional profile at the inboard end of sufficient size to prevent the inboard end of the respective one of the second pair of extension sections from extending beyond the respective one of the outboard openings of the first pair of opposing tubular extension sections.

8. The extendible buoyant board of claim 6 wherein each of the outboard openings of the first pair of opposing tubular extension sections has a lip extending into the outboard opening and each of the second pair of extension sections has an inboard end with a flange extending outward from the inboard end configured to engage the lip of the respective outboard opening of the first pair of opposing tubular extension sections.

9. The extendible buoyant board of claim 6 wherein each of the first pair of opposing tubular extension sections has a plurality of recesses configured to receive outward protrusions and each of the second pair of extension sections has an inboard end with a plurality of outward protrusions configured to engage one or more of the recesses of the respective one of the first pair of opposing tubular extension sections.

10. The extendible buoyant board of claim 6 wherein each of the first pair of opposing tubular extension sections has a plurality of inward protrusions configured to extend into recesses and each of the second pair of extension sections has an inboard end with a plurality of recesses configured to engage one or more of the inward protrusions of the respective one of the first pair of opposing tubular extension sections.

11. The extendible buoyant board of claim 1, wherein the bladder has a valve to selectively receive and release compressed gas.

12. The extendible buoyant board of claim 1, wherein the bladder is secured to a tubular section.

13. The extendible buoyant board of claim 1, wherein a tubular section has a raised longitudinal rib formed on the interior surface and an adjacent tubular section has a longitudinal groove formed on the interior surface configured to receive the longitudinal rib.

14. The extendible buoyant board of claim 1, wherein a tubular section has a raised longitudinal rib formed on the exterior surface and an adjacent tubular section has a longitudinal groove formed on the interior surface configured to receive the longitudinal rib.

* * * * *